United States Patent [19]

Madden

[11] 4,201,290

[45] May 6, 1980

[54] CARRYING CASE FOR HERBS AND MEDICINE

[76] Inventor: Henry L. Madden, 1442 Oakdale, Shreveport, La. 71108

[21] Appl. No.: 966,942

[22] Filed: Dec. 6, 1978

[51] Int. Cl.[2] ..... A45C 15/00; B65D 69/00

[52] U.S. Cl. ..... 206/38; 30/62; 132/79 G; 206/228; 206/352

[58] Field of Search ..... 30/34 R, 62, 123; 132/79 R, 79 G; 206/37-38, 223, 228-229, 234, 349, 352, 525-526, 542, 553, 803; 224/2 D

[56] References Cited

U.S. PATENT DOCUMENTS

| | | | |
|---|---|---|---|
| D. 172,726 | 7/1954 | Polk | 206/38 |
| 330,649 | 11/1885 | Watts | 132/79 G |
| 808,143 | 12/1905 | Dawson | 132/79 G X |
| 866,995 | 9/1907 | Wright | 206/803 X |
| 1,603,691 | 10/1926 | Hauser | 132/79 G UX |
| 2,093,537 | 9/1937 | Balint | 206/38 X |
| 2,353,932 | 7/1944 | Schaffer | 132/79 G |
| 2,410,987 | 11/1946 | Mevi | 206/38 R X |
| 2,630,212 | 3/1953 | Mosch | 206/234 X |

*Primary Examiner*—Steven E. Lipman

[57] ABSTRACT

A carrying case for herbs and medicine is provided as a solid block of polished wood having a plurality of wells bored in one end to receive pill bottles, vials of herbs and other folk remedies, a small spoon, or other implements, there being a leather flap fastened to the block along one edge and snapped to the block at the other such that the flap covers both the above described wells and a mirror mounted to one side to act as a sorting surface, there being a blade removably inserted in a slot in the bottom of the block for use in separating herbs on the mirror sorting surface.

3 Claims, 6 Drawing Figures

CARRYING CASE FOR HERBS AND MEDICINE

BACKGROUND OF THE INVENTION

Pill boxes have been long known to mankind, probably having been invented about the same time as were pills. These pill boxes are of course good for transporting one type of pill but provide no other amenities other than the handy containment of the pills.

In keeping with the current directions in which folk medicine is headed, a person heavily into the use of medicines and herbs for preventive purposes has no real use for a simple pill box but rather requires something capable of carrying and sorting different pills and capsules of vitamins, minerals and food supplements as well as one or move of a variety of herbs used preventatively by a suprisingly large number of herbal health afficianados. These herbs are often used in quantities that are roughly controlled visually, and thus it would be useful if in addition to merely providing containers for the herbs a carrying case in addition provides a surface such as a mirror upon which the herb may be placed, and a blade of some kind useful in separating off the quantity of herbs desired on the separating surface.

SUMMARY OF THE INVENTION

The present invention fulfills the above referenced needs and provides a multi-purpose carrying case for use primarily in carrying and sorting both pills, capsules and the like, and shredded or powdered herbal substances.

The unit is provided as an attractive wooden block having a plurality of wells disposed in one end which house containers or vials of the medicinal or herbal substances as well as small spoons or other utinsels needed to extricate the herbs from their containers. However the unit is much more than simply a carrying case and includes a mirror on the side which is used to sort and divide the herbs which are sprinkled on the surface so that the proper quantity is used. The blade used to separate the herbs can also be used to cut pills and capsules, as occaisonally it is not desired to consume a whole pill. This blade is usefully and attractively housed in a handle and frictionally received in a slot in the wooden block so that when inserted in its carrying mode defines a smooth contour merging with adjacent surfaces of the wooden block to present a finished appearance.

DETAILED DESCRIPTION OF THE PREFERRED EMBODIMENT

Figure 1:
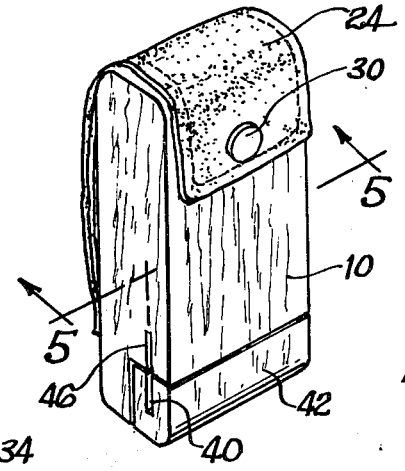
FIG. 1 is a perspective view of the carrying case with the flap closed.
Figure 3:
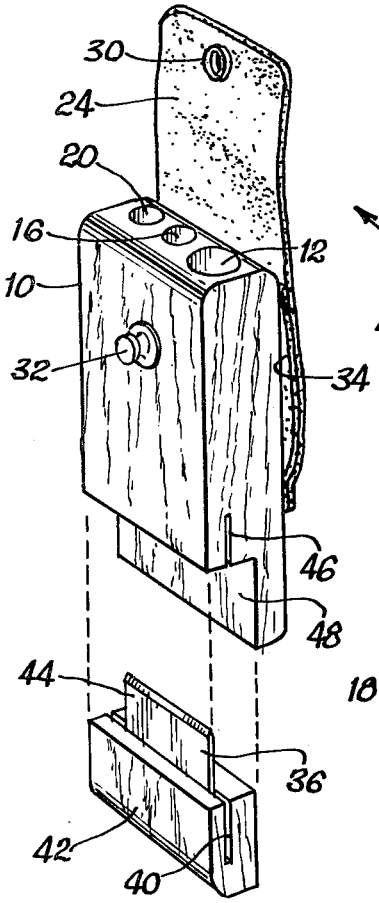
FIG. 3 is an explosed perspective view of the unit with the flap open.

The carrying case has an elongated block 10 which in the preferred form is attractively made from rubbed, shaped wood which has an attractive grain. The top portion of the block is provided with a number of wells which may vary in practice but is 3 as shown. One of the wells 12 is relatively shallow compared to the rest and is dimensioned to contain a vial or bottle 14 of herbs, vitamin pills or any other folk remedy as well as conventional medicines. The second well 16 is taller and more slender than the first well and contains a small spoon 18 which can used to extricate shredded or flaked herbs from the vial 16.

A third well 20 is shown which can be used for miscellaneous purposes. Obviously the arrangement, number and shape of these wells is subject to variation to accomodate particular needs.

Figure 6:
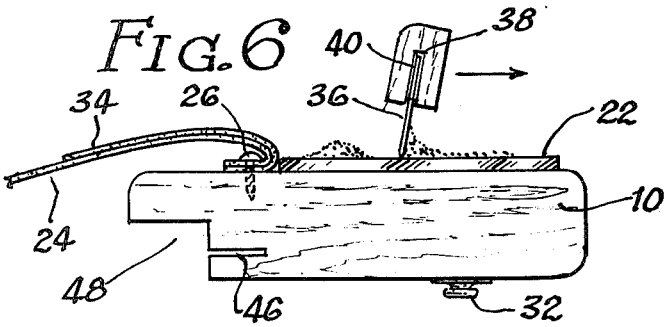
FIG. 6 is a side elevation view showing the unit horizontally extended with the blade in view.

As can clearly be seen the block 10 is flat sided and on one side a flat, smooth impervious surface is defined, in the illustrated embodiment by a mirror 22. This mirror is used as a sorting surface as shown in FIG. 6 as will be described hereinafter. A mirror is ideal as it reflects light and makes it easy to see what has been placed on the surface.

Figure 2:
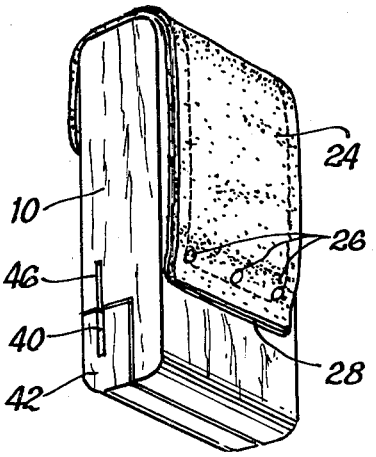
FIG. 2 is a perspective view of the unit shown in FIG. 1 but from the opposite perspective.
Figure 5:
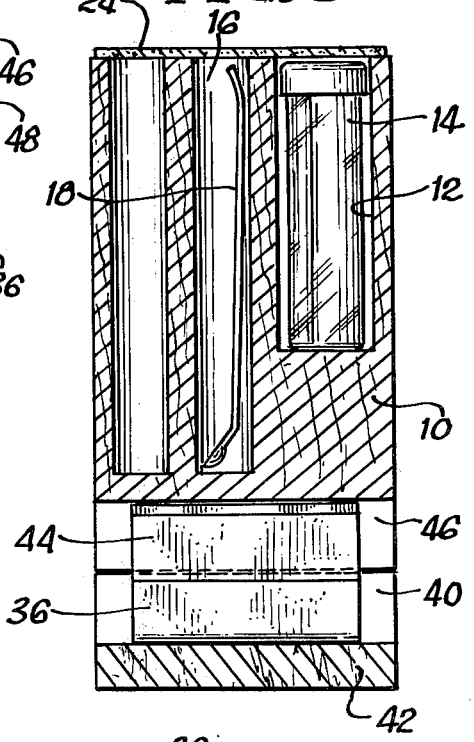
FIG. 5 is a sectional view taken along line 5—5 of FIG. 1.
Figure 4:
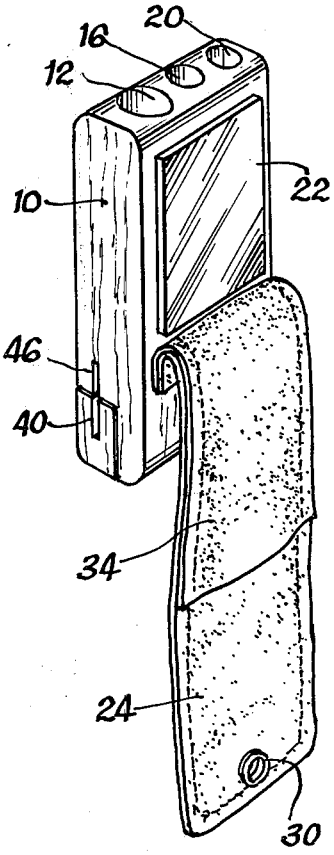
FIG. 4 is a perspective view of the case from the rear showing the flap open to expose the mirror surface.

A flexible flap 14 is fastened by tacks 26 or the like along one edge 28 to the block. The upper edge of this flap is provided with a snap half 30 which mates with corresponding snap element 32 so that when the flap is snapped closed as shown in FIGS. 1 and 2, the flap covers and protects the mirror 22 and acts as a lid for the wells 12, 16 and 20 to prevent any viles or implements contained therein from falling out. As a double protection for the mirror surface 22, and also acting as a separate pouch, a second flexible sheath 34 may be sown to the interior of the flap 24. This member in addition to acting as a pouch for packets of tea or herbs serves as a protective barrier in addition to the flap itself over the mirror element 22 to ensure this element does not become broken even under hard use.

The last significant element of the invention comprises a blade which in the preferred embodiment is a single edged razor blade 36. The thickened, blunt edge 38 of the razor blade is inserted preferably edge-wise into slit 40 in the edge of the blade handle or holder 42. The thin, edge-defining portion 44 of the blade is inserted in a slot 46 cut in a rectangular chink or cut-away area 48 of the body of the unit. This portion of the blade is frictionally held in this spot and as is clearly seen from the drawings the shape of the holder 42 is such that it continues the smooth, unbroken contour of the block 10.

In use, the herb or other medicinal substance is removed from the vial 14 and placed on the mirror surface 22 which is horizontally extended as shown in FIG. 6. The blade 36 is then used to segregate the desired quantity of the material which is then scooped into a teacup, sprinkled on food or consumed in any other desired fashion.

It is also within the scope of the uses of the case that tablets or capsules could be divided by use of the razor blade, as many health enthusiasts are very precise about the quantity of vitamins, minerals and other nutrients they feel their body needs.

Thus the case is ideally suited for many applications and universally accomodates virtually any type of herb or food supplement usage, as well as being large enough not to easily be lost and small enough to be portable in the shirt pocket or purse without any problem.

I claim:

1. a carrying case for herbs and medicines comprising:

(a) a substantially solid block;

(b) a plurality of wells defined in said block to define spaces for medicinal treatment implements and containers;

(c) one side of said block having a flat, smooth surface thereon for use as a sorting and separating surface for medicinal particulates;

(d) said block defining a slot and including a straight edged divider blade removably retained in said slot for use in sorting and separating substances on said surface said blade having a handle releasibly retaining said blade and said handle being shaped to define a continuous uninterrupted surface with adjacent external surface portions of said block;

(e) a flexible flap mounted along one edge to said block and having a terminal fastener at one edge opposite said one edge to releasibly fasten to a portion of said block; and (f) said flap being mounted and dimensioned such that when said terminal fastener is fastened said flap is extended substantially flush over said sorting surface to protect same and said wells to provide a cover for same.

2. Structure according to claim 1 wherein said blade is a single-edged razor blade and said slot is defined in chink cut out from said block.

3. Structure according to claim 1 wherein said handle portion defines a slit which frictionally retains said razor blade therein, and the slot in said block is dimensioned to frictionally retain said razor blade, together with the handle portion therein.

* * * * *